US006390523B2

(12) United States Patent
Fujikawa et al.

(10) Patent No.: US 6,390,523 B2
(45) Date of Patent: May 21, 2002

(54) BELT HOIST

(75) Inventors: Masaru Fujikawa; Koji Saai, both of Osaka (JP)

(73) Assignee: Elephant Chain Block Co., Ltd. (JP)

( * ) Notice: Subject to any disclaimer, the term of this patent is extended or adjusted under 35 U.S.C. 154(b) by 0 days.

(21) Appl. No.: 09/801,732

(22) Filed: Mar. 9, 2001

(30) Foreign Application Priority Data

Jun. 16, 2000 (JP) ..... 2000-182067

(51) Int. Cl.[7] ..... B66C 1/34
(52) U.S. Cl. ..... 294/82.11; 24/197; 24/265 H
(58) Field of Search ..... 294/74, 82.11, 294/82.14; 24/68 PP, 115 H, 115 K, 197–200, 265 H

(56) References Cited

U.S. PATENT DOCUMENTS

| | | | | |
|---|---|---|---|---|
| 3,131,450 A | | 5/1964 | Zinkel, Jr. | 24/197 |
| 3,222,743 A | | 12/1965 | Alofs | 24/165 |
| 4,365,391 A | | 12/1982 | Chapalain | 24/197 |
| 4,493,135 A | * | 1/1985 | Crook, Jr. | 24/197 |
| 4,641,875 A | | 2/1987 | Speich | 294/82.11 |
| 5,018,774 A | * | 5/1991 | Rasmussen | 294/74 |
| 5,058,243 A | | 10/1991 | Rasmussen | |
| 5,269,578 A | | 12/1993 | Fandrey | |
| 6,030,015 A | | 2/2000 | Fujikawa et al. | 294/82.11 |

FOREIGN PATENT DOCUMENTS

| | | |
|---|---|---|
| DE | 682482 | 10/1939 |
| DE | 32 35 299 | 3/1984 |
| DE | 3344485 | 3/1985 |
| DE | 9010180 | 1/1991 |
| EP | 0 091 992 | 10/1983 |
| GB | 1 381 344 | 1/1975 |

* cited by examiner

*Primary Examiner*—Dean J. Kramer
(74) *Attorney, Agent, or Firm*—George T. Marcou; Kilpatrick Stockton LLP

(57) ABSTRACT

A belt hoist designed to enable a hanging member to be further reliably secured to a belt to provide a further improved safety under load less than a permissible maximum load. In the belt hoist, a winding shaft 44 on which one end portion of a belt 3 is coiled comprises a first shaft 44*a* and a second shaft 44*b*, and the one end portion of the belt 3 comprises a first coiling portion 31 coiled on the first shaft 44*a* to be superposed thereon, a second coiling portion 32 coiled on the first coiling portion 31 to be superposed thereon, a third coiling portion 33 coiled on the second shaft 44*b* to be superposed thereon, and a fourth coiling portion 34 coiled on the third coiling portion 33 to be superposed thereon. The first coiling portion 31 and the second coiling portion 32, and the third coiling portion 33 and the fourth coiling portion 34 are opposite to each other in coiling direction, and the hanging member 4 has press-holding portions 49 for pressing at least one of the second coiling portion 32 and the fourth coiling portion 34 in sandwich relation therebetween.

2 Claims, 5 Drawing Sheets

Prior Art

BELT HOIST

BACKGROUND OF THE INVENTION

1. Field of the Invention

This invention relates to a belt hoist wherein a hanging member, such as a hook, is secured to one end portion of a belt extended from a winding member so that a load hooked with the hanging member is hoisted up and down or dragged.

2. Description of the Prior Art

A single-hung type belt hoist having the structure in which the hanging member is secured to one end portion of the belt extended from the winding member has a disadvantage that when the one end portion of the belt is merely secured to the hanging member in a clipping manner, a slippage can be caused at the one end portion of the belt by a load applied to the hanging member that is less than a permissible maximum load, so that the one end portion of the belt is easily fallen out from the hanging member at the clipping portion thereof.

In consideration of this circumstance, the applicant of the present invention previously filed an application for patent (which matured into Japanese Patent No. 2,852,737) (which corresponds to U.S. Pat. No. 6,030,015) for a belt hoist that is so designed that the hanging member is secured to one end portion of the belt through a single winding shaft on which the belt is coiled, to well prevent the one end portion of the belt from being slipped due to the load applied to the hanging member which is less than a permissible maximum load, so as to achieve a firm mounting of the hanging member.

Specifically, the belt hoist of the Japanese Patent No. 2,852,737 has the structure in which a hanging member 102 is secured to one end portion of a belt 100 extended from a winding member through a single winding shaft 101 winding the belt 100 therearound, as shown in FIG. 5. The one end portion of the belt 100 has a first coiling portion 103 coiled to be superposed on the winding shaft 101, a second coiling portion 104 coiled to be superposed on the first coiling portion 103, and the first coiling portion 103 and the second coiling portion 104 are coiled in opposite directions to each other. The hanging member 102 has a press-holding portion 105 to press-hold the second coiling portion 104 in sandwich relation.

In this type of belt hoist, the first coiling portion 103 and the second coiling portion 104 are pulled in the direction for the winding shaft 101 to be tightened by a load applied to the hanging member 102, so that the winding shaft 101 can be coiled up double tightly to prevent the one end of the belt 100 from falling out from the hanging member 102, so as to achieve a firm mount of the hanging member 102.

According to the invention of Japanese Patent No. 2,852,737, although the belt can be prevented from being fallen out due to a load less than the permissible maximum load to achieve the firm mount of the hanging member, since the hanging member is secured to the belt without using any specific fixing means such as bolts and the like, it is desirable to prevent the falling of the belt further reliably, so as to provide further improved safety under load less than the permissible maximum load.

It is the object of the present invention to provide a belt hoist that can prevent the falling of the belt further reliably to provide further improved safety under load less than a permissible maximum load.

SUMMARY OF THE INVENTION

The present invention is directed to a novel belt hoist having a hanging member which is secured to one end portion of a belt extended from a winding member via a winding shaft on which the belt is coiled, wherein the winding shaft comprises a first shaft and a second shaft which are spaced in an opposed relation, wherein the one end portion of the belt comprises a first coiling portion coiled on the first shaft to be superposed thereon, a second coiling portion coiled on the first coiling portion to be superposed thereon, a third coiling portion coiled on the second shaft to be superposed thereon, and a fourth coiling portion coiled on the third coiling portion to be superposed thereon, wherein the first coiling portion and the second coiling portion are opposite to each other in a coiling direction and the third coiling portion and the fourth coiling portion are opposite to each other in the coiling direction, and wherein the hanging member has press-holding portions for pressing at least one of the second coiling portion and the fourth coiling portion in sandwich relation therebetween.

According to the present invention, the first coiling portion and the second coiling portion are pulled in the direction for the first shaft to be coiled up by the load applied to the hanging member and the belt, and the third coiling portion and the fourth coiling portion are pulled in the direction for the second shaft to be coiled up by the load applied to the hanging member and the belt. As a result of this, the first shaft and the second shaft are each coiled up double tightly. Further, at least one of the second coiling portion and the fourth coiled portion are pressed in sandwich relation to maintain the coiled state of the belt. By virtue of this, the one end portion of the belt can be further reliably prevented from being fallen out, so that the hanging member can be secured thereto further firmly to provide a further improved safety under load less than a permissible maximum load.

According to the present invention, it is preferable that the first shaft and the second shaft are movable close to or away from each other.

This construction enables the first shaft and the second shaft to move close to each other by the load applied to the first coiling portion coiled on the first shaft to be superposed thereon and the third coiling portion coiled on the second shaft to be superposed thereon, so that the coiling portions of the belt can be held in sandwich relation between the first shaft and the second shaft. By virtue of this, the one end portion of the belt can be further reliably prevented from being fallen out, so that the hanging member can be secured thereto further firmly to provide a further improved safety under load less than a permissible maximum load.

DETAILED DESCRIPTION OF THE PREFERRED EMBODIMENT

Figure 1:
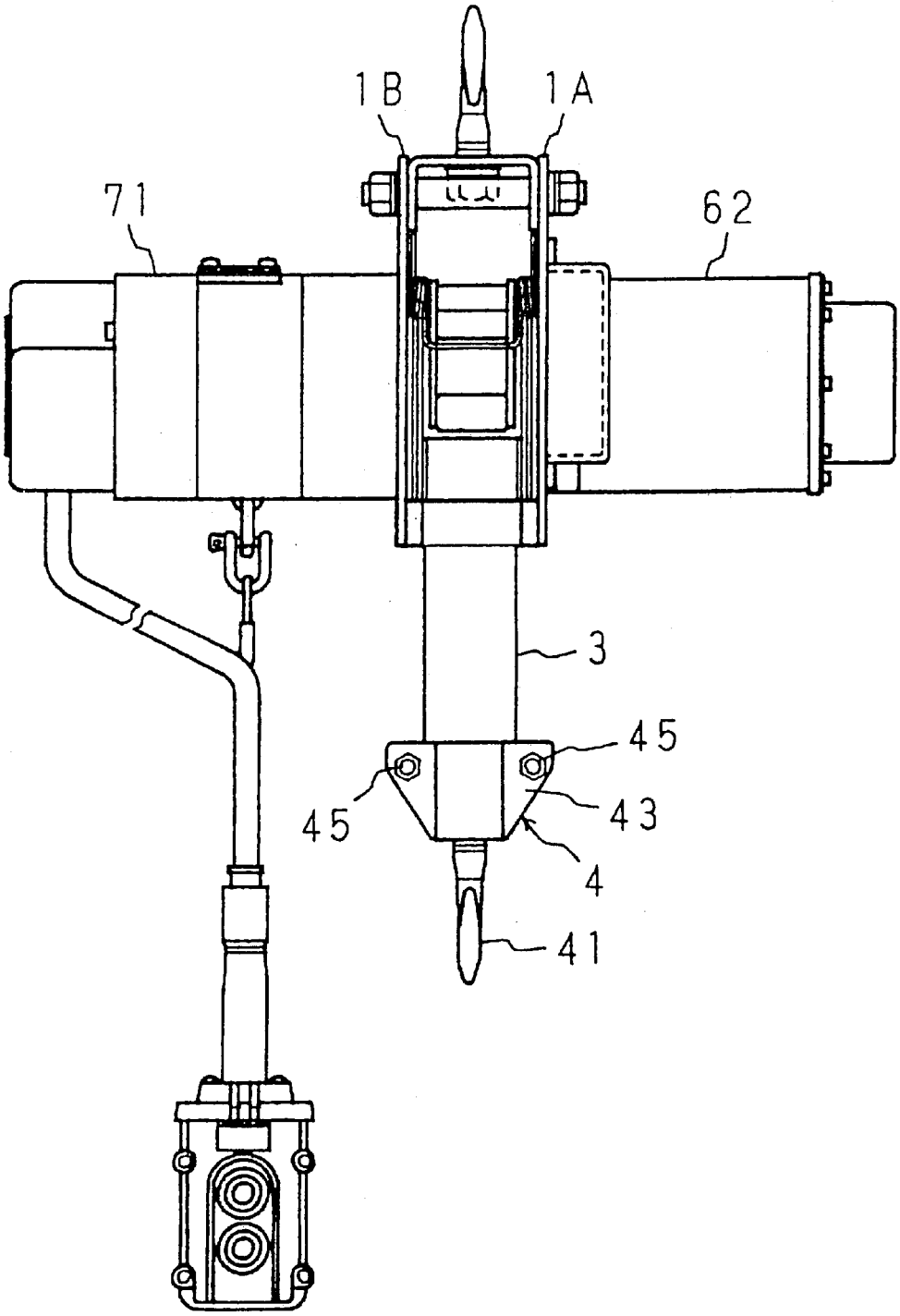
FIG. 1 is a rear view of a belt hoist according to the present invention.
Figure 2:
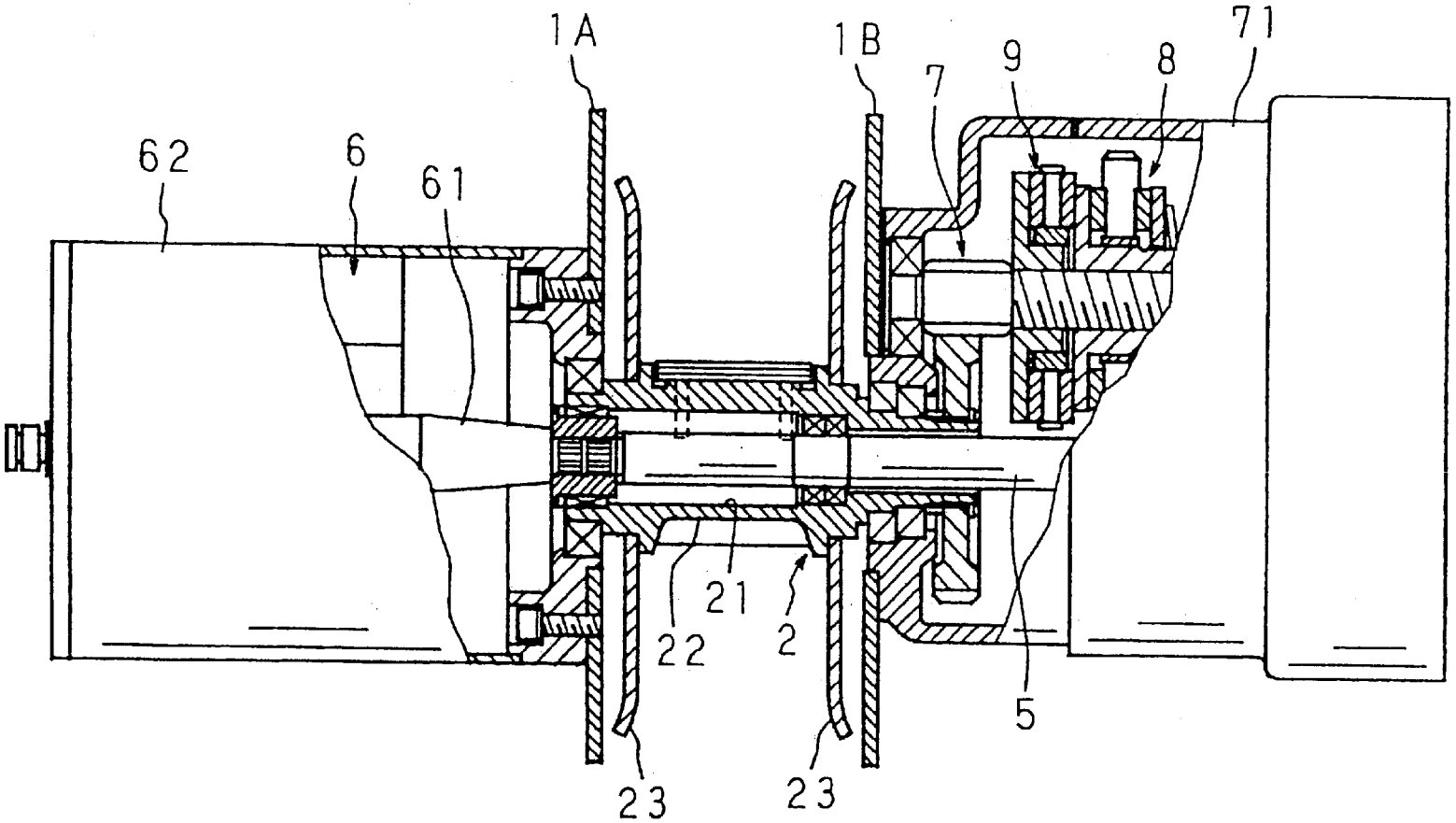
FIG. 2 is a partly cut-out plan view of the belt hoist according to the present invention.
Figure 3:
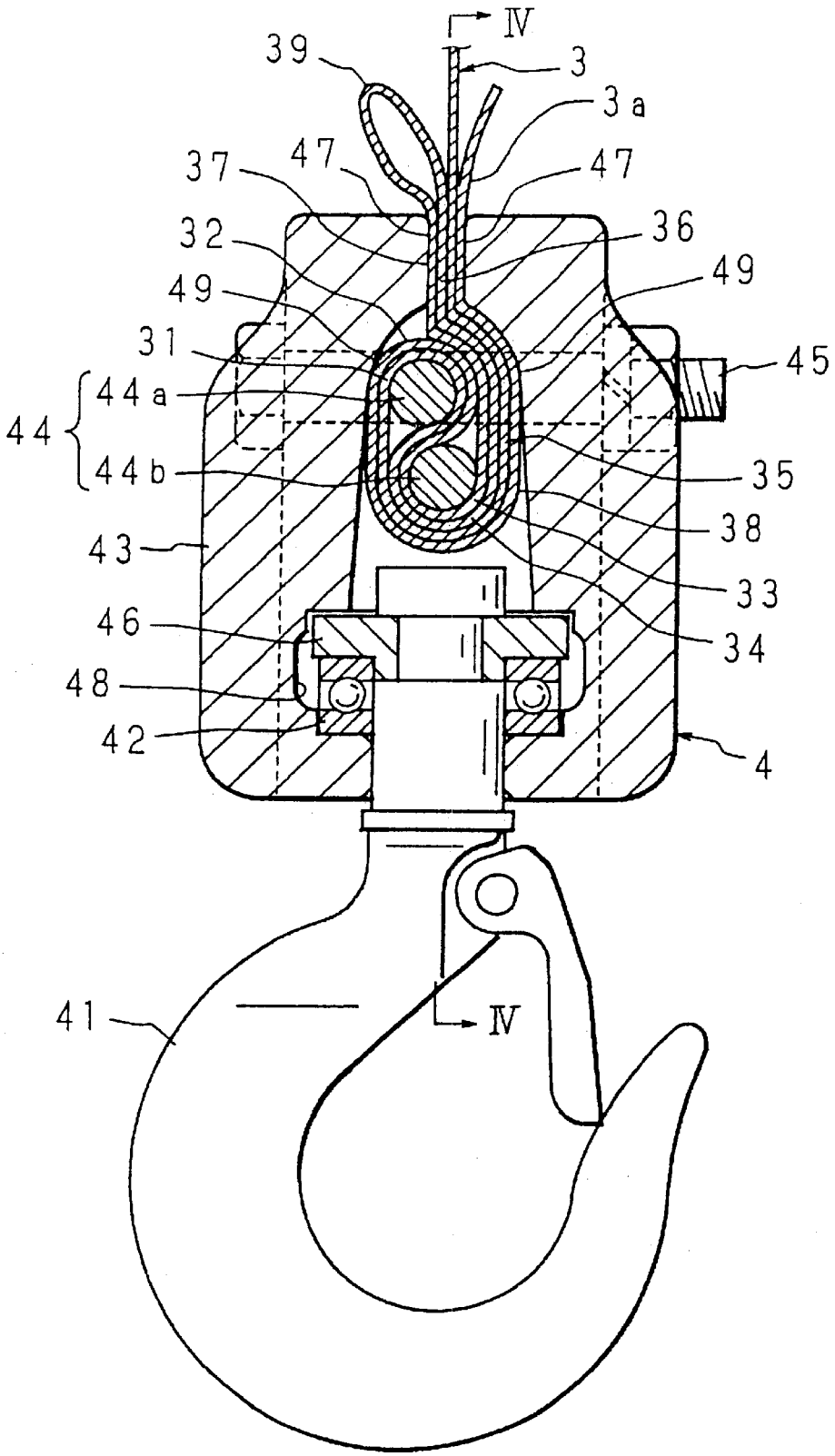
FIG. 3 is an enlarged sectional view of the hanging member part of the belt hoist according to the present invention.
Figure 4:
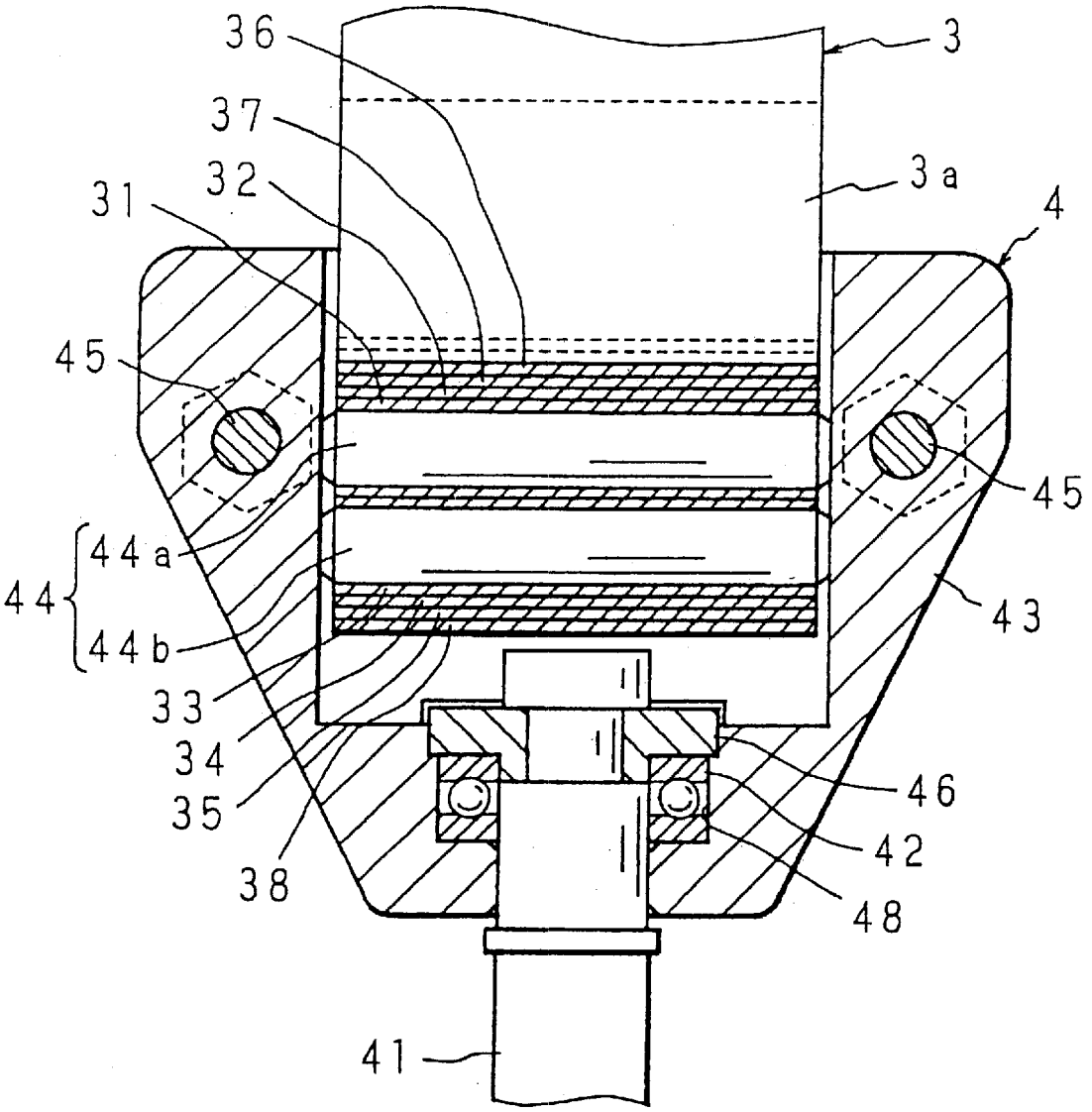
FIG. 4 is a sectional view taken along line IV—IV of FIG. 3.
Figure 5:
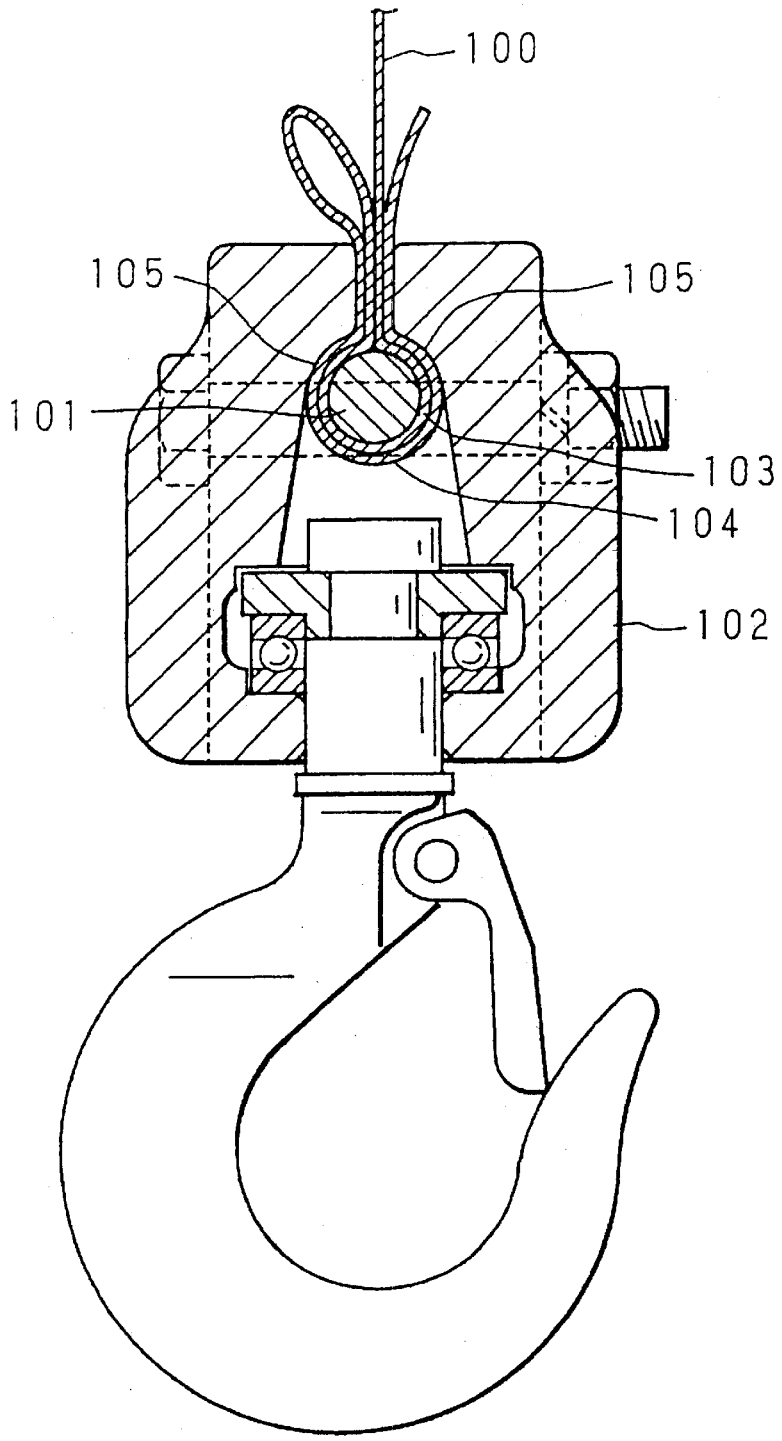
FIG. 5 is an enlarged sectional view of the hanging member part of a conventional type of belt hoist.

In the following, the present invention will be described in detail by way of an illustrative embodiment with reference to the accompanying drawing figures. FIG. 1 is a rear view of a belt hoist; FIG. 2 is a partly cut-out plan view of the belt hoist; FIG. 3 is an enlarged sectional view of the hanging member part of the belt hoist; and FIG. 4 is a sectional view taken along line IV—IV of FIG. 3.

Referring to FIG. 1, the belt hoist illustrated therein comprises a pair of laterally spaced apart and confronting side plates 1A, 1B; a cylindrical winding member 2 having a shaft insertion bore 21 at the center thereof and rotatably supported between the pair of side plates 1A, 1B via a pair of bearings; a belt 3 wound on the winding member 2; a hanging member 4 detachably secured to one end portion of the belt 3 extended from the winding member 2; a drive shaft 5 rotatably supported in a shaft insertion bore 21 of the winding member 2 via a pair of bearings; a motor 6 disposed at an outside of the side plate 1A and having a motor shaft 61 connected with the drive shaft 5 and capable of rotating in a normal direction and a reverse direction; and a reduction gear mechanism 7 disposed at an outside of the side plate 1B to reduce rotational speed of the drive shaft 5 to transmit the rotation to the winding member 2. The drive of the motor 6 drives the winding member 2 to rotate in the normal direction or in the reverse direction through the drive shaft 5 and the reduction gear mechanism 7. The motor 6 is covered with a cover 62 mounted on the side plate 1A, and the reduction gear mechanism 7 is covered with a cover 71 mounted on the side plate 1B. Arranged between the drive shaft 5 and the reduction gear mechanism 7 are an overloading prevent mechanism 8 and a mechanical brake 9.

The winding member 2 has a winding portion 22 on which the belt 3 is wound and disc-like winding flanges 23, 23 projecting from the winding portion 22 at the opposite ends thereof. The other end portion of the belt 3 is fixed to the winding portion 22.

The hanging member 4 comprises a generally J-shaped hook 41; a hook joint 43 which is divided into two halves and holds a base end portion of the hook 41 in a rotatable manner via a thrust bearing 42; and a winding shaft 44 which is disposed in the hook joint 43 and winds the one end portion of the belt 3 therearound; and a pair of tightening screws 45, 45 for jointing the halves of the hook joint 43. The thrust bearing 42 and a retaining ring 46 for the thrust bearing 42 are carried by the hook 41 at the base end thereof.

The hook joint 43 has, at its upper end portion on the inside, first, flat, press-holding portions 47 which are recessed with respect to surfaces of the halves and hold the belt 3 with such a relation as to press it in the thickness direction. It also has, at its lower end portion on the inside, circular, holding cavity 48 which are recessed with respect to the surfaces of the halves, to accommodate the thrust bearing 42 and the retaining ring 46 therein. Further, it has, at its intermediate portion between the first press-holding portions 47 and the holding cavity 48, second press-holding portions 49 which are recessed with respect to the first holding portions 47 and hold the winding shaft 44 via the belt 3 with such a relation as to press it, so that when the two halves are joined with their surfaces in abutting relation by tightening the tightening screws 45, 45, the second press-holding portions 49 can allow the winding shaft 44 to be pressed in sandwich relation through the belt 3. The outside of the hook joint 43 is subjected to surface treatment such as coating painting. On the other hand, the press-holding portions 47, 49 on the inside of the hook joint 43 are made to have substrate surfaces without any surface treatment to thereby produce increased contact resistance of the press-holding portions 47, 49 against the belt 3, so as to prevent the belt 3 from being easily slipped.

The winding shaft 44 comprises a first shaft 44*a* and a second shaft 44*b* which are vertically spaced in an opposed relation at the inside of the second press-holding portions 49. The first shaft 44*a* and the second shaft 44*b* are arranged to be movable close to and away from each other.

The one end portion of the belt 3 has a folded portion 3*a* of a proper length, an intermediate portion of which is coiled around the first shaft 44*a* and the second shaft 44*b* in such a manner as to be opposite to each other in the coiling direction. Thus, the one end portion of the belt 3 comprises a first coiling portion 31 coiled on the first shaft 44*a* to be superposed thereon, a first superposing portion 35 extending continuously toward one end of the first coiling portion 31, a fourth coiling portion 34 extending continuously toward the other end of the first coiling portion 31 to be coiled around the second shaft 44*b* through a third coiling portion 33 as mentioned later, a second superposing portion 36 extending continuously to the fourth coiling portion 34 to be superposed on an inside portion of the first superposing portion 35, a third superposing portion 37 extending continuously to the second superposing portion 36 through a turnup portion 39 to be superposed on an inside portion of the second superposing portion 36, the third coiling portion 33 extending continuously to one end portion of the third superposing portion 37 to be coiled around the second shaft 44*b* so as to be superposed on it, a second coiling portion 32 extending continuously to one end portion of the third coiling portion 33 to be coiled around the first coiling portion 31 so as to be superposed onto it, and a fourth superposing portion 38 extending continuously to one end portion of the second coiling portion 32 to be superposed on an outer portion of the first superposing portion 35.

The first coiling portion 31 and the second coiling portion 32 are opposite to each other in coiling direction, and the third coiling portion 33 and the fourth coiling portion 34 are opposite to each other in coiling direction. The first coiling portion 31 and the fourth coiling portion 34 are identical to each other in coiling direction, and the second coiling portion 32 and the third coiling portion 33 are identical to each other in coiling direction.

The belt 3 thus coiled around the first shaft 44*a* and the second shaft 44*b* is arranged in the press-holding portions 47, 49 of the hook joint 43, so that when the two halves of the hook joint 43 are joined together with the tightening screws 45, 45, the first to fourth superposing portions 35–38 of the belt 3 can be pressed in sandwich relation by the first press-holding portions 47 and the first and second coiling portions 31, 32 and the first through fourth superposing portions 35–38 can be pressed in sandwich relation by the second press-holding portions 49.

In use of the belt hoist thus structured, the winding member 2 is rotated in a normal rotation direction or a reverse rotation direction by the drive of the motor 6, to wind up or wind off the belt 3 onto or from the winding member 2, so that a load hooked with the hook 41 of the hanging member 4 secured to the one end portion of the belt 3 is raised, lowered or dragged.

In this raising, lowering or dragging operation, the belt 3 is tensioned by the load which is transmitted to the belt 3 through the hook 41, the hook joint 43 and the second press-holding portion 49. The tension acts on the first coiling portion 31 and the third coiling portion 33 in a couterclockwise direction as viewed in FIG. 3, while on the other hand, the tension acts on the second coiling portion 32 and the fourth coiling portion 34 in a clockwise direction as viewed in FIG. 3. As a result of this, the first coiling portion 31 and the second coiling portion 32 are tensed in the direction for the first shaft 44*a* to be wound up, and the third coiling portion 33 and the fourth coiling portion 34 are tensed in the direction for the second shaft 44*b* to be wound up. Thus, the first shaft 44*a* and the second shaft 44*b* are each coiled up double tightly. In addition, a part of the second coiling portion 32 is pressed in sandwich relation by the second press-holding portions 49, to maintain the coiled state of the belt 3. Thus, by virtue of the coiling up of the first and second shafts 44*a*, 44*b* and the pressing of the second coiling portion 32 in sandwich relation, the one end portion of the belt 3 can be further reliably prevented from being fallen out. This can provide a further reliable securement of the hanging member 4 and thus a further improved safety under a load less than a permissible maximum load.

In addition, since the first shaft 44*a* and the second shaft 44*b* can be moved close to from each other by winding up the first shaft 44*a* and the second shaft 44*b* to hold the coiling portions of the belt 3 in sandwich relation between the first shaft 44*a* and the second shaft 44*b*, the one end portion of the belt 3 can be even further reliably prevented from being fallen out. This can provide an even further reliable securement of the hanging member 4 and thus an even further improved safety under a load less than a permissible maximum load.

Also, since the first press-holding portions 47 of the hanging member 4 press the first to fourth superposing portions 35–38 of the belt 3 in sandwich relation therebetween, the belt 3 can be prevented from moving with respect to the hanging member 4. Thus, even if the belt 3 is wound down excessively by the drive of the motor 6, such that the hanging member 4 is brought into contact with the ground and as a result of this no load is applied to the belt 3, the belt 3 can be prevented from moving with respect to the hanging member 4 to well maintain the belt 3 in the state of being coiled around the first shaft 44*a* and the second shaft 44*b*.

Further, as shown in FIG. 3, the third superposing portion 37 and the fourth superposing portion 38 of the one end portion of the belt 3 are in contact with the first press-holding portions 47 of the hook joint 43, whereby a loaded part of the one end portion of the belt 3 extending between the hanging member 4 and the winding member 2 is prevented from contacting with the hook joint 43. Thus, the belt 3 is effectively prevented from being worn due to the contact with the hook joint 43.

While, in the embodiment described above, the hook joint 43 is so structured that the when the two halves of the hook joint 43 are joined together with the tightening screws 45, 45, the part of the second coiling portion 32 can be pressed in sandwich relation by the second press-holding portions 49, in other words, the first and second coiling portions 31, 32 and the first to fourth superposing portions 35–38 can be pressed in sandwich relation by the second press-holding portions 49, alternation of this structure may be taken in which the second press-holding portions 49 are formed so that the distance between the spaced-apart, second press-holding portions 49 can become narrower toward the upper ends, as shown in FIG. 3, so that the part of the second coiling portion 32 can be wedged in between the second press-holding portions 49 by the load applied to the belt 3 so as to be pressed in sandwich relation therebetween.

While, in the embodiment described above, the first shaft 44*a* and the second shaft 44*b* are supported to the hook joint 43 through the belt 3, alternation of this structure may be taken in which the hook joint 43 is provided with shaft holes to support either or both of the first shaft 44*a* and the second shaft 44*b* therein.

While the illustrative embodiments of the present invention are provided in the above description, such is for illustrative purpose only and it is not to be construed restrictively. Modification and variation of the present invention that will be obvious to those skilled in the art is to be covered by the following claims.

What is claimed is:

1. A belt hoist having a hanging member which is secured to one end portion of a belt extended from a winding member via a winding shaft on which the belt is coiled, wherein the winding shaft comprises a first shaft and a second shaft which are spaced in an opposed relation, wherein the one end portion of the belt comprises a first coiling portion coiled on the first shaft to be superposed thereon, a second coiling portion coiled on the first coiling portion to be superposed thereon, a third coiling portion coiled on the second shaft to be superposed thereon, and a fourth coiling portion coiled on the third coiling portion to be superposed thereon, wherein the first coiling portion and the second coiling portion are opposite to each other in a coiling direction and the third coiling portion and the fourth coiling portion are opposite to each other in the coiling direction, and wherein the hanging member has press-holding portions for pressing at least one of the second coiling portion and the fourth coiling portion in sandwich relation therebetween.

2. The belt hoist according to claim 1, wherein the first shaft and the second shaft are movable close to or away from each other.

* * * * *